US005934488A

United States Patent [19]

Grimshaw

[11] Patent Number: 5,934,488

[45] Date of Patent: Aug. 10, 1999

[54] OVERHEAD SKI RACK

[76] Inventor: Gene E. Grimshaw, 5338 State Route 104, Oswego, N.Y. 13126

[21] Appl. No.: 09/055,783

[22] Filed: Apr. 7, 1998

[51] Int. Cl.[6] ..... A47F 7/00

[52] U.S. Cl. ..... 211/70.5; 211/113

[58] Field of Search ..... 211/70.5, 113, 211/118

[56] References Cited

U.S. PATENT DOCUMENTS

| | | | |
|---|---|---|---|
| 1,093,856 | 4/1914 | Hurff | 211/113 |
| 1,691,123 | 11/1928 | Pajeau | 211/113 |
| 3,235,095 | 2/1966 | Neill | 211/113 |
| 3,330,573 | 7/1967 | Seiloff | 211/70.5 |
| 4,856,744 | 8/1989 | Frankel | 211/113 |
| 4,936,602 | 6/1990 | Adkins | 211/70.5 |
| 5,193,694 | 3/1993 | Wave | 211/70.5 |
| 5,788,133 | 8/1998 | Mareno | 211/70.5 |

*Primary Examiner*—Alvin Chin-Shue
*Assistant Examiner*—Sarah Purol
*Attorney, Agent, or Firm*—Oliff & Berridge, PLC

[57] ABSTRACT

An overhead ski rack includes a pair of support structures disposed apart from one another and connected to an overhead support surface. Each support structure includes a first end portion, a second end portion, a first arm and a second arm. The first end portion is adapted for connecting to an overhead support surface such that the support structure depends downwardly therefrom to terminate in the second end portion. The first arm is connected to the second end portion of the support structure and extends substantially perpendicularly therefrom in a first direction. The second arm is connected to the second end portion of the support structure and extends substantially perpendicularly therefrom in a second direction which is opposite the first direction.

20 Claims, 5 Drawing Sheets

OVERHEAD SKI RACK

BACKGROUND OF THE INVENTION

1. Field of Invention

The invention is directed to a ski rack. In particular, the invention is directed to an overhead ski rack for stowing snow skis, ski poles and ski boots.

2. Description of Related Art

Many different types of ski racks are known in the art. One such ski rack is described in U.S. Pat. No. 4,763,797 to Egan. This ski rack mounts on a wall and includes a pair of top and bottom rails with a gap formed therebetween. Several sets of opposed retainer blocks are provided along the length of the top and bottom rails and are connected thereto through the gap. The retainer blocks have face portions that engage the edges of a ski as the ski is slid downwardly between the retainer the blocks. The ski is retained on the ski rack by the engagement of the face portions of the blocks with the edges of the ski. Also, the retainer blocks are movable toward and away from each other so as to accommodate varying widths of skis.

Another ski and ski pole stowing rack is taught in U.S. Pat. No. 5,193,694 to Wave. The ski and ski pole stowing rack fastens onto a vertical support. The ski and ski pole stowing rack has an upper and two lower members that hold two pairs of skis by placing the skis sideways along their edges in a bottom-to-bottom facing arrangement in a cylindrical slot provided by the upper member. As the skis are brought downwardly within the cylindrical slot, the rear ends of the skis are inserted into a pouch which is provided by a lower member. A stretchable elastic element that is connected to the upper member is pulled and placed over the skis to retain them in place. The upper member also includes two projecting cylindrical elements so that strapped or strapless ski poles may be hung therefrom.

Yet another conventional ski rack is disclosed in U.S. Pat. No. 3,330,573 to Sieloff. The ski rack is designed to hold a pair of skis on a wall. The ski rack includes a camber retainer device, a bracket device and a clamp device. The camber retainer device is mounted on the wall and is adapted to be positioned under the pair of skis at a longitudinal center point of each of the skis. The bracket device is mounted on the wall and is adapted to receive and encircle the rear ends of the pair of skis. The clamp device is mounted on the wall and is disposed in alignment with the camber retainer device and the bracket device. The clamp device is adapted to receive the front ends of the pair of skis for clamping the skis onto the wall.

Another ski rack is disclosed in U.S. Pat. No. 2,919,032 to Sinawski. The ski rack includes a horizontal ski support member and a horizontal retaining member. Each of the ski support member and the ski retaining member includes a plurality of U-shaped openings formed therein. Also, the ski rack has a locking device for locking individual pairs of skis within the rack. The ski rack may be hung from floor joists, attached to a wall or set on a floor. The ski rack also includes means to prevent marring of the skis while they are racked. The ski rack also includes hooks for hanging other equipment thereon.

None of the ski racks described above provide stowing of ski boots. Often, after snow skiing, the insides of the ski boots are wet from perspiration, melted snow or both. Thus, there is a need to stow ski boots after skiing at a place where the insides of the ski boots can be dried.

SUMMARY OF THE INVENTION

The invention is directed to an overhead ski rack for stowing skis, ski poles as well as ski boots. The overhead ski rack includes a pair of support structures, a pair of fixture members and a pair of fasteners. Each support structure includes a pair of support members, a cross member, a first arm and a second arm. The pair of support members are disposed apart from one another in a generally parallel relationship and the cross member interconnects the pair of support members to form a generally U-shaped support structure that defines a plane. The first arm is disposed apart from the cross member and is connected to one of the pair of support members in a manner to extend generally perpendicularly from the plane in a first direction. The second arm is disposed apart from the cross member and in connected to a remaining one of the pair of support members in a manner to extend generally perpendicularly from the plane in a second direction opposite the first direction.

Each fixture member is adapted for mounting to an overhead support surface such as a ceiling of a room. Additionally, each fixture is releasably connected to a respective support structure. Each fastener is adapted for fastening respective fixture members to the overhead support surface. The pair of support structures are spaced apart from one another at a distance less than the length of the skis and are oriented such that the first and second arms of one support structure and the first and second arms of a remaining support structure extend parallel to each other so that one ski with one ski boot connected thereto can be placed on the first arms and the remaining ski with the other ski boot connected thereto can be placed on the second arms.

BRIEF DESCRIPTION OF THE DRAWINGS

The invention will become more readily appreciated and understood from a consideration of the following detailed description of the preferred embodiments of the invention when taken together with the accompanying drawings in which.

DETAILED DESCRIPTION OF PREFERRED EMBODIMENTS

Figure 1:
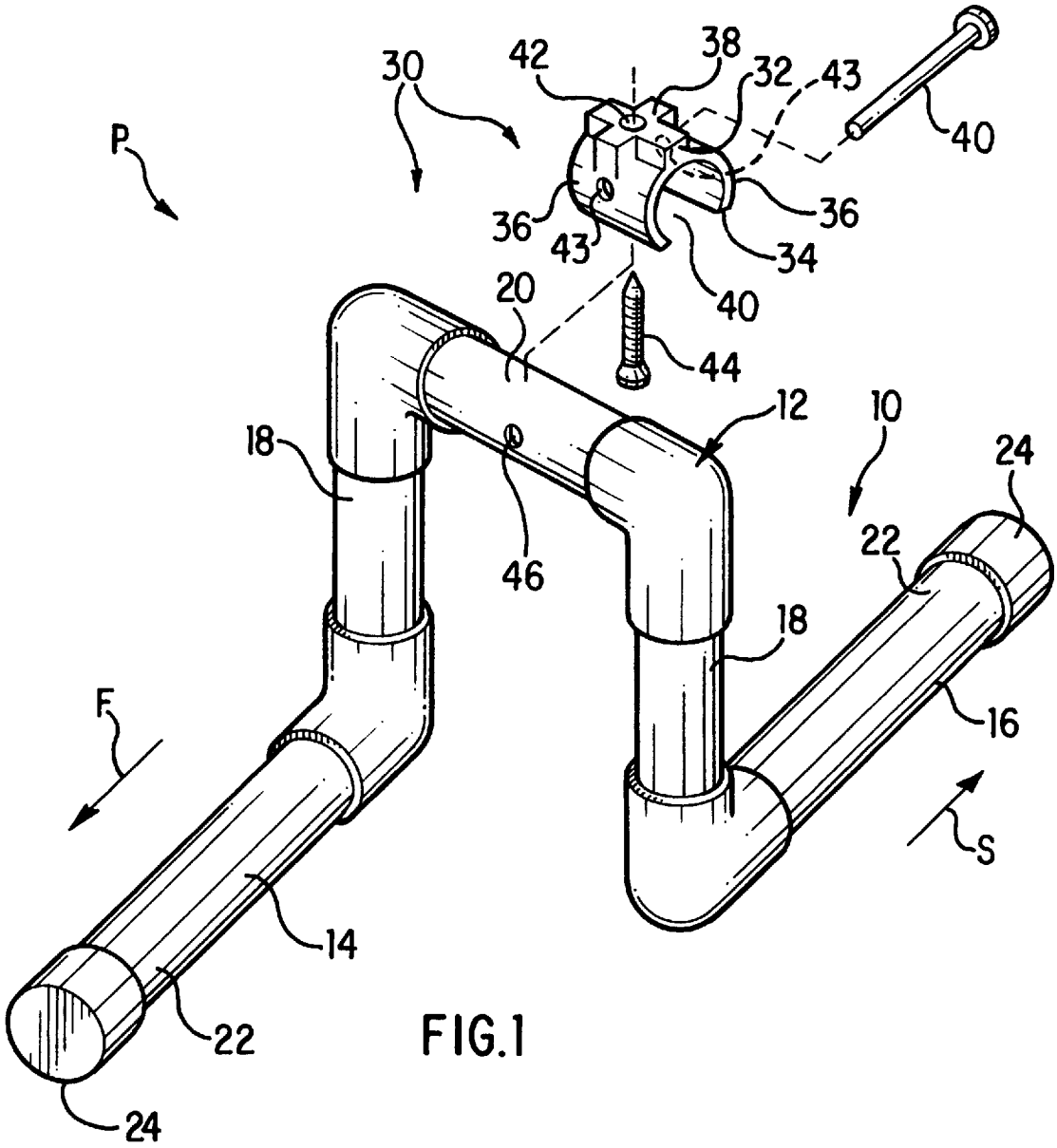
FIG. 1 is a perspective view of a first preferred embodiment of a bracket apparatus of the invention.

An overhead ski rack of the invention is hereinafter described. However, one of ordinary skill in the art would appreciate that the overhead ski rack of the invention can be used as an overhead storage rack system for stowing one or more elongated objects other than skis. Such elongated objects can be stored with or separately from the skis and include ski poles, fishing rods, ladders and other elongated objects.

The overhead ski rack of the invention is discussed in further detail below and includes a pair of bracket apparatuses 10 as shown in FIGS. 1–4 which is a first preferred embodiment of the invention.

The bracket apparatus 10 includes a generally U-shaped support structure 12, a first arm 14 and a second arm 16. The support structure 12 includes a pair of support members 18 that are disposed apart from one another in a generally parallel relationship. The support structure 12 also includes a cross member 20 that interconnects the pair of support members 18 to form the generally U-shaped support structure 12. The U-shaped support structure defines a plane P.

As shown in FIG. 1, the first arm 14 is disposed apart from the cross member 20 and is connected to one of the pair of support members 18. Specifically, the first arm 14 is connected to the one of the pair of support members 18 such that the first arm 14 extends generally perpendicularly from the plane P in a first direction as shown by arrow F. Similarly, the second arm 16 is disposed apart from the cross member 20 and is connected to a remaining one of the pair of support members 18. Likewise, the second arm 16 extends generally perpendicularly from the plane P but extends in a second direction shown by arrow S which is opposite to the first direction F. Both the first arm 14 and the second arm 16 include a distal end portion 22 which are disposed opposite to the respective ones of the pair of support members 18 connected to the first and second arms 14, 16.

It is preferred that the bracket apparatus 10 of the invention include stop elements 24. Each stop element 24 is sized and adapted to be connected to a respective one of the distal end portions 22 of the first and second arms 14, 16 as shown in FIG. 1.

Although not by way of limitation, the bracket apparatus 10 of the invention is fabricated from plastic. Particularly, the support structure 12, the first arm 14 and the second arm 16 are fabricated from plastic pipe sections, such as PVC (polyvinylchloride). Additionally, the stop elements 24 in a form of end caps are fabricated from PVC. As illustrated in FIGS. 1–4, the plastic pipe sections are connected together by conventional PVC pipe elbows and fastened to each other by a convention PVC adhesive. Using conventional PVC pipe sections and PVC pipe elbows makes fabrication of the bracket apparatus 10 of the invention simple and easy because of the wide availability of PVC materials. However, similar components made of metal can be used and joined by soldering, welding, or threaded attachments, for example.

Figure 2:
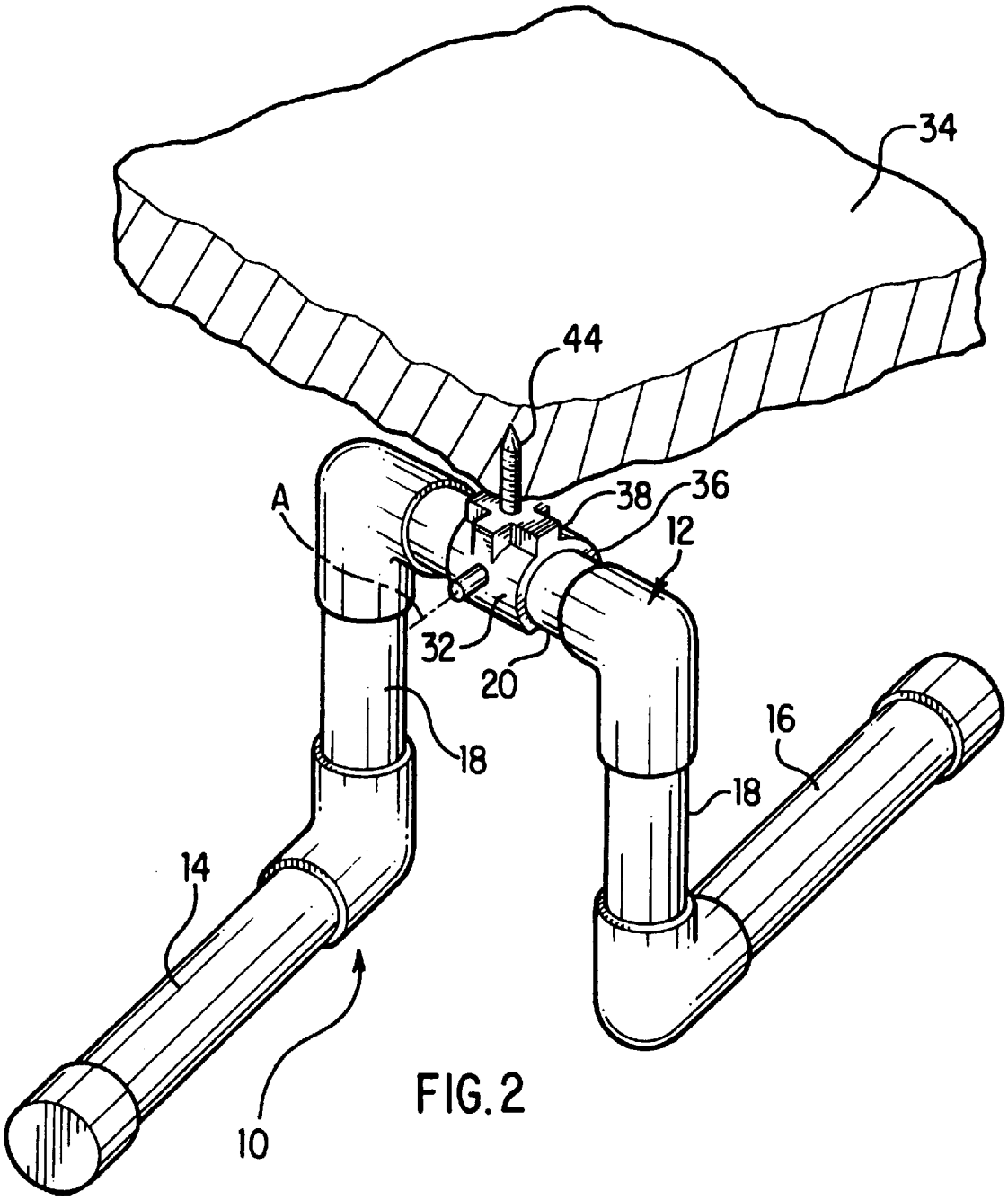
FIG. 2 is a perspective view of the bracket apparatus of the invention shown in FIG. 1 mounted to an overhead support structure such as a ceiling.

A bracket assembly 30 of the invention includes the bracket apparatus 10 and fixture member 32 as shown in FIGS. 1 and 2. As best shown in FIG. 2, the fixture member 32 mounts to an overhead support surface 34, such as the ceiling of a room. Also, the fixture member 32 is adapted to connect to the bracket apparatus 10. It is preferred that the fixture member 32 releasably connects to the cross member 20. Preferably, the fixture member 32 includes a pair of jaws 36 and a mounting plateau 38. The mounting plateau 38 is positioned between and connects the pair of jaws 36 to each other. Although not by way of limitation, a plan view of the mounting of plateau 36 is configured in a "cross" shape that defines a flat surface for mounting the fixture member 32 onto the overhead support surface 34.

The pair of jaws 36 form an opening 40 sized to receive the cross member 20 in a gripping relationship as shown in FIG. 2.

The fixture member 32 includes a fastener hole 42 that extends from the opening 40 through a center of the mounting plateau 38. The fastener hole 42 is sized to receive a fastener 44 illustrated as a conventional screw so that the fixture member 32 can be secured to the overhead support surface 34 as shown in FIG. 2.

Further, each of the pair of jaws 36 include a hole 43 formed therethrough. Each hole 43 communicates exteriorly of the fixture member 32 and communicates with the opening 40. The cross member 20 includes a bore 46 as shown in FIG. 1 which extends therethrough. When the fixture member 32 is releasably connected to the cross member 20, the holes 43 and the bore 46 align coextensively along an axis A shown in FIG. 2. When aligned, a pin element 46, appropriately sized, is inserted through the aligned holes 43 and the bore 46 so that the bracket apparatus 10 is secured to the fixture member 32. This pin element arrangement not only prevents the pair of jaws 36 from inadvertently releasing the bracket apparatus 10 when releasably connected together but also it prevents the cross member 20 from twisting inside the opening 40, particularly when a ski is placed on either the first arm 14 or the second arm 16.

Figure 3:
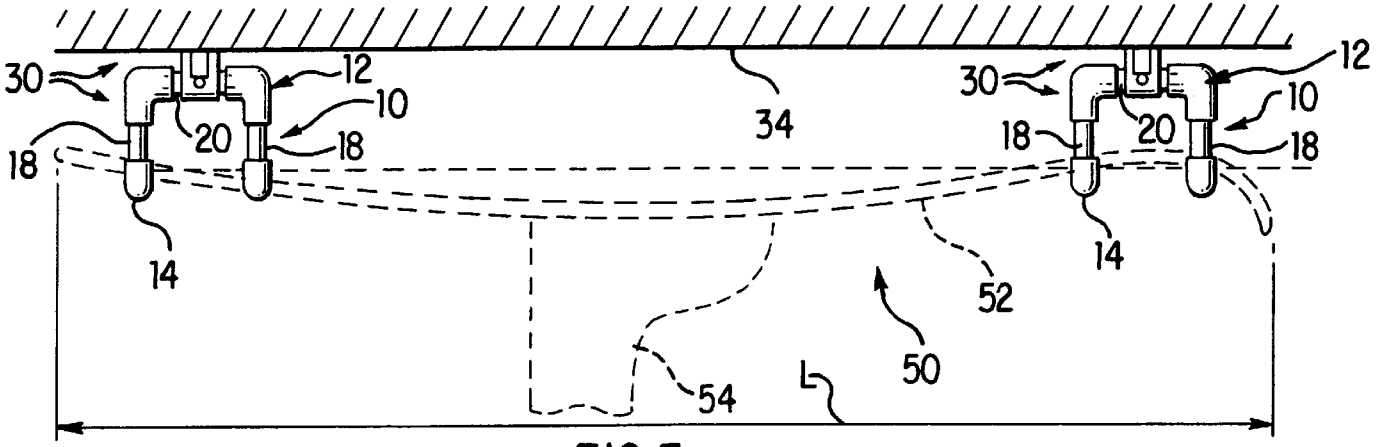
FIG. 3 is an overhead ski rack of the invention mounted to the overhead support surface with a phantomly-drawn ski and ski boot stowed thereon.
Figure 4:
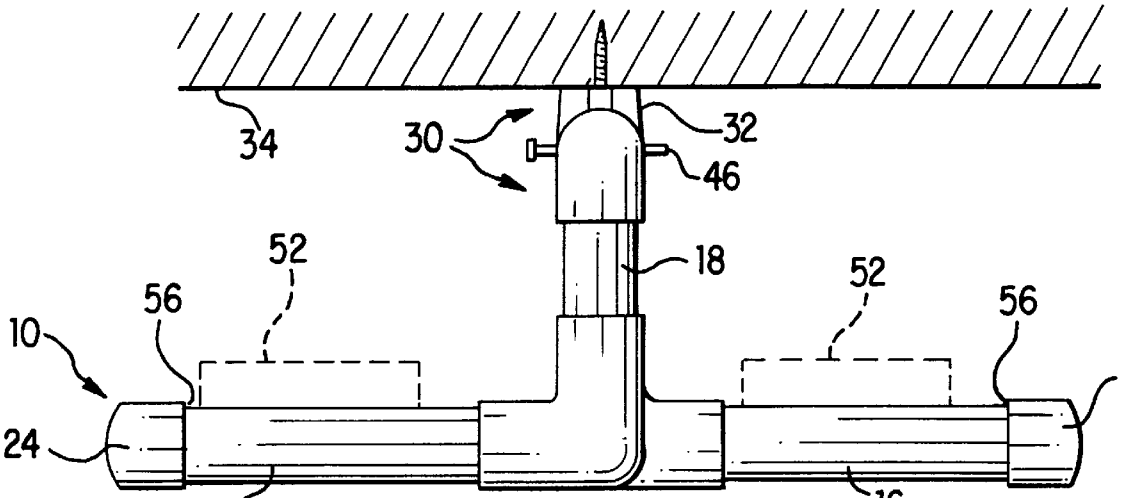
FIG. 4 is a rear view of the bracket assembly shown in FIG. 2 with a pair of phantomly-drawn skis shown in cross section placed on respective first and second arms.

As best shown in FIGS. 3 and 4, a pair of bracket assemblies 30 are mounted to the overhead support surface 34 to form an overhead ski rack 50 of the invention. The pair of bracket assemblies 30 are spaced apart from one another at a distance that is less than a length L of a ski 52 (or other items to be held) so that the ski 52 may be stowed thereon. Furthermore, the pair of bracket assemblies 30 are oriented such that the first and second arms 14 and 16, respectively, of one bracket assembly 30 and the first and second arms 14 and 16, respectively, of the other bracket assembly 30 extend parallel to each other so that the ski 52 can be placed on the first arms 14 or the second arms 16 of the bracket assemblies 30. Shown by way of example only, the ski 52 is placed on the first arms 14 of the bracket assemblies 30.

A ski boot 54 can be connected to the ski 52 in a conventional manner comprehended by one of ordinary skill in the art. The ski boot 54 hangs upside-down from the ski 52 placed on the overhead ski rack 50. One advantage of stowing the ski 52 with the ski boot 54 connected to it is that the ski boot 54 can also be stowed. Also, as previously mentioned, other elongated objects can also be stowed on the overhead ski rack. In this case, ski poles can also be placed on the overhead ski rack 50. Additionally, the ski 52 is stowed in a bowed state which is its natural camber.

In FIG. 3, the cross member 20 extends horizontally while the pair of the support members 18 connected to the cross member 20 depend downwardly from the cross member 20 to form an inverted U-shaped configuration. Correspondingly, the first and second arms 14 and 16 of each bracket assembly 30 also extend horizontally. In FIG. 4, a pair of skis 52 are placed on respective first and second arms 14 and 16. Note the stop elements 24 provide an abutment wall 56 which inhibits a ski 52 from sliding off the first or second arm if the bracket assembly 30 is tilted.

Figure 5:
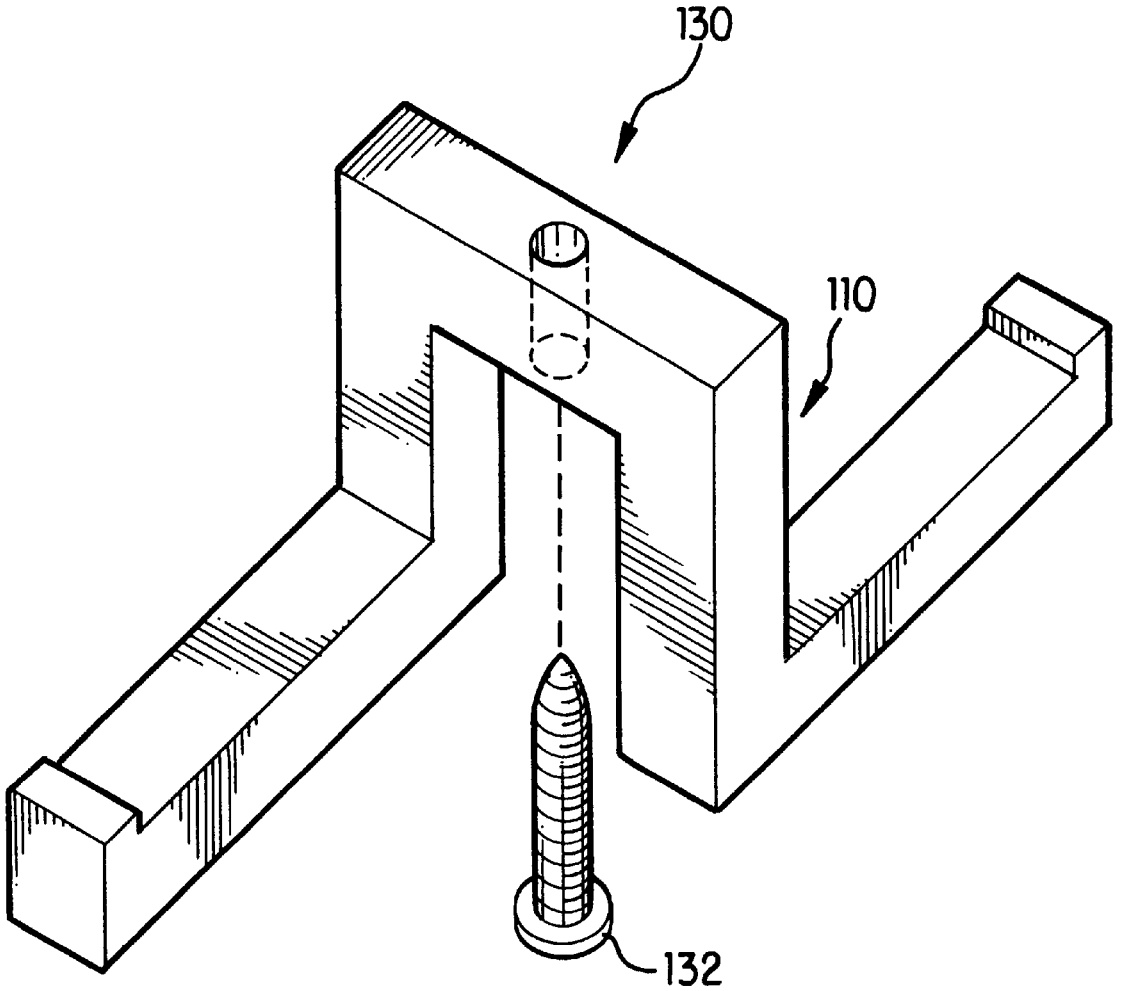
FIG. 5 is a perspective view of a second preferred embodiment of the bracket apparatus of the invention.

A second preferred embodiment of a bracket assembly 130 is introduced in FIG. 5. The bracket assembly 130 includes a bracket apparatus 110 having a rectangular cross sectional configuration. Also, the bracket apparatus 110 is of unitary construction that can be fabricated from plastic, metal or wood. A fixture member 132 shown is a conventional screw that is used to mount the bracket apparatus 110 to the overhead support surface. However, depending on the overhead surface other devices, such as nails, adhesives or rivets could be used.

Figure 6:
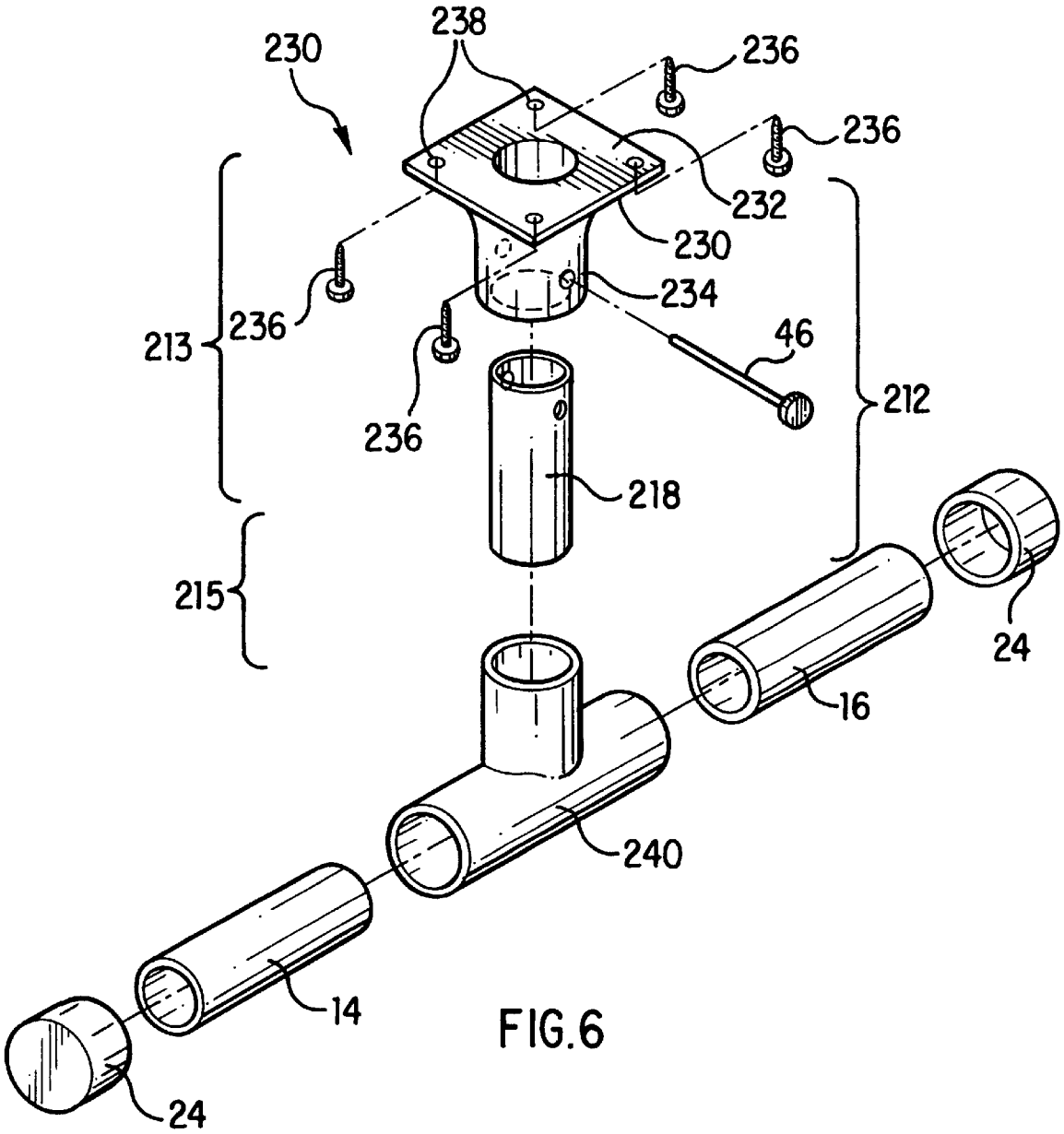
FIG. 6 is perspective view of a third preferred embodiment of the bracket apparatus of the invention.

A third preferred embodiment of a bracket assembly 230 is shown in FIG. 6. The bracket assembly 230 includes a support structure 212 that has a first end portion 213 and a second end portion 215. The first end portion 213 is adapted for connecting the bracket assembly 230 to the overhead support surface. When connected to the overhead support surface, the support structure 212 depends downwardly from the overhead support surface to terminate at the second end portion 215. The first end portion 213 includes a fixture member 230 and a connecting member 218. The fixture member 230 has a flat mounting plate 232 connected to a receptacle 234 that releasably connects to the connecting member 218 using the pin element 46 and hole/bore arrangement in a similar manner as described above. Alternatively, the connecting member could be threadably mounted in the receptacle 234 or adhesively fixed therein. The fixture member 232 is connected to the overhead support surface by conventional screws 236 through respective pilot holes 238 formed in the flat mounting plate 232. Again, alternative mounting, schemes are possible, such as nails or adhesives. The first and second arms 14, 16 are connected to the second end portion 215 by a conventional T connector 240. The distal ends of the first and second arms 14 and 16 are connected to respective stop elements 24.

The invention has been described with particularity in connection with the preferred embodiments. However, it should be appreciated that changes may be made to the disclosed embodiments of the invention without departing from the spirit and inventive concepts contained herein.

What is claimed is:

1. A bracket apparatus, comprising:

a support structure including a pair of support members and a cross member, the pair of support members disposed apart from one another in a generally parallel relationship, the cross member interconnecting the pair of support members to form a generally U-shaped support structure defining a plane;

a first arm disposed apart from the cross member and connected to one of the pair of the support members in a manner to extend generally perpendicularly from the plane in a first direction; and a second arm disposed apart from the cross member and connected to a remaining one of the pair of support members in a manner to extend generally perpendicularly from the plane in a second direction opposite the first direction.

2. A bracket apparatus according to claim 1, further comprising a pair of stop elements, each stop element sized and adapted to connect to a respective one of distal end portions of the first and second arms, the distal end portions disposed opposite of respective ones of the pair of support members.

3. A bracket apparatus according to claim 1, wherein the support structure, the first arm and the second arm are fabricated from pipe sections.

4. A bracket apparatus according to claim 1, wherein the support structure, the first arm and the second arm are a unitary construction.

5. A bracket assembly for mounting to an overhead support surface, comprising:

a support structure including a pair of support members, a cross member, a first arm and a second arm, the pair of support members disposed apart from one another in a generally parallel relationship, the cross member interconnecting the pair of support members to form a generally U-shaped support structure defining a plane, the first arm disposed apart from the cross member and connected to one of the pair of the support members in a manner to extend generally perpendicularly from the plane in a first direction, the second arm disposed apart from the cross member and connected to a remaining one of the pair of support members in a manner to extend generally perpendicularly from the plane in a second direction opposite the first direction; and a fixture member disposed between the overhead support surface and the support structure and interconnecting the overhead support surface and the support structure.

6. A bracket assembly according to claim 5, wherein the fixture member is releasably connected to the cross member of the support structure.

7. A bracket assembly according to claim 6, wherein the fixture member includes a pair of jaws and a mounting plateau positioned between and connecting the pair of jaws to each other, the pair of jaws defining an opening between the pair of jaws, the opening sized to receive the cross member in a gripping relationship.

8. A bracket assembly according to claim 7, wherein each of the pair of jaws includes a hole formed therethrough and in communication with the opening and wherein the cross member includes bore extending therethrough whereby, when the fixture member is releasably connected to the cross member, the holes and the bore align coextensively along an axis.

9. A bracket assembly according to claim 8, further comprising a pin element sized to be received by the aligned holes and bore to secure the support structure to the fixture member.

10. A bracket assembly according to claim 5, further comprising a pair of stop elements, each stop element sized and adapted to connect to a respective one of distal end portions of the first and second arms, the distal end portions disposed opposite of respective ones of the pair of support members.

11. A bracket assembly according to claim 5, further comprising a fastener for mounting the fixture member to the overhead support surface.

12. An overhead storage rack system for stowing at least one elongated object of a fixed length onto an overhead support surface, comprising:

a pair bracket assemblies, each bracket assembly including:

a support structure having a first end portion adapted for connecting to the overhead support surface, the support structure depending downwardly from the overhead support surface to terminate at a second end portion;

a first arm connected to the second end portion of the support structure and extending substantially perpendicularly therefrom in a first direction; and a second arm connected to the second end portion of the support structure and extending substantially perpendicularly therefrom in a second direction opposite the first direction, wherein the pair of bracket assemblies are disposed apart from one another at a distance less than the fixed length of the at least one object to be stowed and oriented such that the first and second arms of one bracket assembly and the first and second arms of a remaining bracket assembly extend parallel to each other so that the at least one object can be placed on either the first arms or the second arms.

13. An overhead storage rack system according to claim 12, wherein the first end portion includes a fixture member and a connecting member, the fixture member connected to the overhead support surface, the connecting member releasably connected to the fixture member.

14. An overhead storage rack system according to claim 13, wherein the connecting member includes a horizontally extending cross member and a pair of support members connected to the cross member and depending downwardly therefrom to form an inverted U-shaped configuration and wherein each support member terminates to define the second end portion.

15. An overhead storage rack system according to claim 14, wherein a respective first arm is connected to one of the pair of support members and a respective second arm is connected to a remaining one of the pair of support members.

16. An overhead storage rack system according to claim 13, further comprising a pin element sized and adapted to be received by a hole formed through the fixture member and the connecting member.

17. An overhead ski rack system for stowing skis onto an overhead support surface, comprising:

a pair of support structures, each support structure including a pair of support members, a cross member, a first arm and a second arm, the pair of support members disposed apart from one another in a generally parallel relationship, the cross member interconnecting the pair of support members to form a generally U-shaped support structure defining a plane, the first arm disposed apart from the cross member and connected to one of the pair of the support members in a manner to extend generally perpendicularly from the plane in a first direction, the second arm disposed apart from the cross member and connected to a remaining one of the pair of support members in a manner to extend generally perpendicularly from the plane in a second direction opposite the first direction;

a pair of fixture members, each fixture member disposed between the overhead support surface and a respective support structure and interconnecting the overhead support surface and the respective support structure; and a pair of fasteners, each fastener adapted for fastening respective ones of the fixture members to the overhead support surface.

18. An overhead ski rack system according to claim 17, further comprising stop elements, each stop element sized and adapted to connect to a respective one of distal end portions of the first and second arms of each support structure, the distal end portions disposed opposite of respective ones of the pair of support members.

19. An overhead storage system, comprising:

a pair of storage units, each storage unit comprising:

an overhead mounting fixture;

a support section having a first end attached to the overhead mounting fixture; and a pair of support arms mounted to a second end of the support section, the pair of support arms extending in parallel with and in opposite direction from each other, a distal end of each support arm having a retention lip.

20. An overhead storage system according to claim 19, wherein the support section comprises:

a center section; and a descending arm at each end of the center section, one support arm of the pair of support arms attached to each descending arm.

* * * * *